US008021129B2

(12) United States Patent
Traylor et al.

(10) Patent No.: US 8,021,129 B2
(45) Date of Patent: Sep. 20, 2011

(54) HYDRAULICALLY ACTUATED SUBMERSIBLE PUMP

(75) Inventors: Leland B. Traylor, Draper, UT (US); Jared Mangum, Spanish Fork, UT (US); Paul A. Treaster, Albuquerque, NM (US)

(73) Assignee: Smith Lift, Inc., Houston, TX (US)

( * ) Notice: Subject to any disclaimer, the term of this patent is extended or adjusted under 35 U.S.C. 154(b) by 1101 days.

(21) Appl. No.: 11/421,157

(22) Filed: May 31, 2006

(65) Prior Publication Data

US 2008/0003118 A1 Jan. 3, 2008

(51) Int. Cl.
*F04B 9/08* (2006.01)

(52) U.S. Cl. ..... 417/383; 417/392; 166/68; 166/105

(58) Field of Classification Search ..... 417/318, 417/368, 383–385, 392, 394, 395; 166/68, 166/105

See application file for complete search history.

(56) References Cited

U.S. PATENT DOCUMENTS 2,861,518 A 11/1958 Pleuger
3,310,001 A * 3/1967 Bickley ..... 417/264
6,183,217 B1 2/2001 Elliott et al.
6,889,765 B1 5/2005 Traylor
2006/0008364 A1 1/2006 Traylor

OTHER PUBLICATIONS

International Search Report and Written Opinion for Appl. No. PCT/US2007/070022 dated Aug. 4, 2008 (6 p.).

Office Action issued in related Chinese Patent Application No. 200780019767.7 with English translation; Dated Jun. 2, 2010 (10 pages).

* cited by examiner

*Primary Examiner* — Charles G Freay
*Assistant Examiner* — Patrick Hamo
(74) *Attorney, Agent, or Firm* — Jim Patterson; Rodney V. Warfford

(57) ABSTRACT

A submersible pumping system comprises a piston that is axially moveable relative to a body between an extended position and a retracted position. A pump valve is coupled to the body and in fluid communication with a supply of operating fluid. The pump valve has a first position, where the pump valve supplies operating fluid so as to move the piston to the extended position, and a second position, where the pump valve supplies operating fluid so as to move the piston to the retracted position. The pumping system also comprises an upper stop that is coupled to the pump valve so that the pump valve is moved to the first position when the upper stop is engaged by the piston in the retracted position. The pumping system also comprises a lower stop that is coupled to the pump valve so that the pump valve is moved to the second position when the lower stop is engaged by the piston in the extended position.

12 Claims, 5 Drawing Sheets

HYDRAULICALLY ACTUATED SUBMERSIBLE PUMP

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates generally to methods and apparatus for submersible pumping systems. More particularly, the present invention relates to methods and apparatus for submersible pumps used in artificial lift systems for producing low flow rate oil, gas and coal bed methane wells.

Hydrocarbons, and other fluids, are often contained within subterranean formations at elevated pressures. Wells drilled into these formations allow the elevated pressure within the formation to force the fluids to the surface. However, in low pressure formations, or when the formation pressure has diminished, the formation pressure may be insufficient to force the fluids to the surface. In these cases, a pump can be installed to provide the required pressure to produce the fluids.

The volume of well fluids produced from a low pressure well is often limited, thus limiting the potential income generated by the well. For wells that require pumping systems, the installation and operating costs of these systems often determine whether a pumping system is installed to enable production or the well is abandoned. Among the more significant costs associated with pumping systems are the costs for installing, maintaining, and powering the system. Reducing these costs may allow more wells to be produced economically and increase the efficiency of wells already having pumping systems.

The operation of a downhole pumping system depends on providing energy to the submerged pump components that generate hydraulic power that lifts fluid from the well. Thus, the transmission of energy between the surface and a downhole pump is one the key elements that determines the efficiency, size, and operating characteristics of a downhole pumping system. This energy can, for example, be in the form of mechanical energy, hydraulic energy, or electrical energy. For example, a rod pump uses a reciprocating steel rod as the means to transmit mechanical energy from the surface to the downhole pump. Rod pumps may be subject to serious limitations, especially under harsh conditions that tend to cause wear in the pump due to the interaction of the pumped fluid with the pressure generating (piston-cylinder) portions of the pump. Other types of pumps rely on electrical power to drive a submerged pumping unit but the use of electric systems is often limited by size restrictions or infrastructure limitations.

There remains a need to develop lower cost, more efficient methods and apparatus for pumping fluids from a low pressure wellbore that overcome some of the foregoing difficulties while providing more advantageous overall results.

SUMMARY OF THE PREFERRED EMBODIMENTS

Embodiments of the present invention include a submersible pumping system comprises a piston that is axially moveable relative to a body between an extended position and a retracted position. A pump valve is coupled to the body and in fluid communication with a supply of operating fluid. The pump valve has a first position, where the pump valve supplies operating fluid so as to move the piston to the extended position, and a second position, where the pump valve supplies operating fluid so as to move the piston to the retracted position. The pumping system also comprises an upper stop that is coupled to the pump valve so that the pump valve is moved to the first position when the upper stop is engaged by the piston in the retracted position. The pumping system also comprises a lower, stop that is coupled to the pump valve so that the pump valve is moved to the second position when the lower stop is engaged by the piston in the extended position.

Thus, the embodiments of present invention comprise a combination of features and advantages that enable substantial enhancement of submersible pumping systems. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a more detailed understanding of the present invention, reference is made to the accompanying Figures, wherein.

DETAILED DESCRIPTION OF THE PREFERRED EMBODIMENTS

Figure 1:
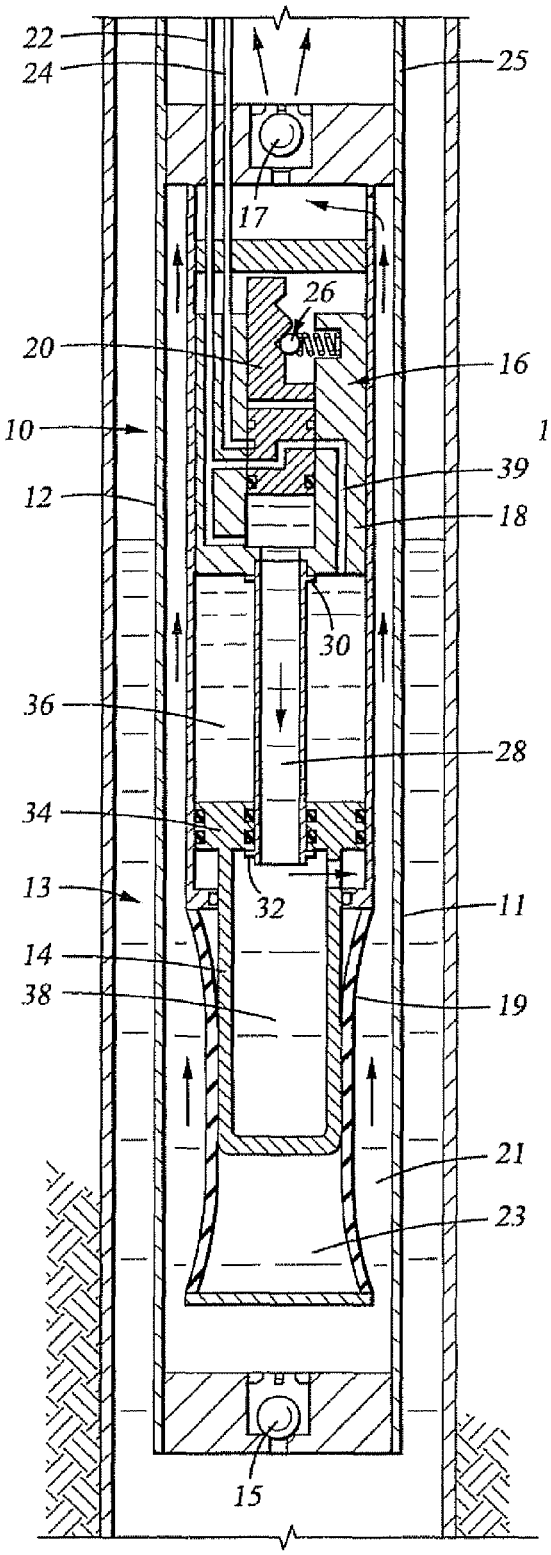
FIG. 1 is a sectional schematic view of a submersible pump assembly shown in a first position.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Figure 2:
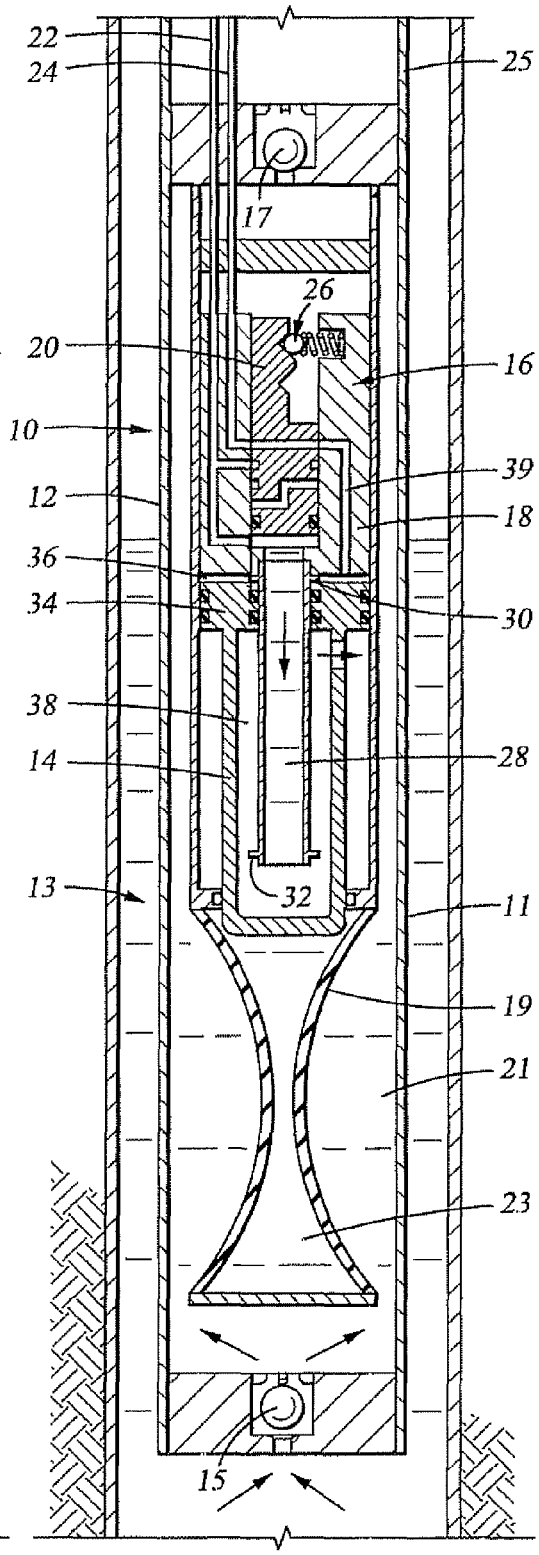
FIG. 2 is the submersible pump assembly of FIG. 1 shown in a second position.

Referring now to FIGS. 1 and 2, pump assembly 10 comprises body 12, piston 14, pump valve 16, valve housing 18, and valve spool 20. Pressurized fluid lines 22 and 24 supply working fluid to valve 16. Pump valve 16 enables piston 14 to move axially relative to valve housing 18 and body 12 in response to fluid supplied through fluid lines 22 and 24. Pump assembly 10 is disposed within pump housing 11, which is disposed within wellbore 13. Pump housing 11 comprises inlet valve 15 and outlet valve 17, which control the flow of fluid through pump chamber 21. Diaphragm 19 may be coupled to body 12 so as to contain piston 14 within a working chamber 23 that is isolated from the wellbore fluids in pump chamber 21.

FIG. 1 illustrates pump assembly 10 in an extended position where piston 14 is at its maximum extension from body 12. As piston 14 extends, the pressure within pump chamber 21 and working chamber 23 increases, opening outlet valve 17 and moving fluid up through tubing 25. FIG. 2 illustrates pump assembly 10 in a retracted position where piston 14 is at its maximum retraction into body 12. As piston 14 retracts into body 12, the pressure within pump chamber and working chamber 23 decreases, opening inlet valve 15 and drawing fluid from the wellbore into the pump chamber. Thus, wellbore fluids are pumped upward through tubing 25 by reciprocating piston 14 between its extended and retracted positions.

The reciprocation of piston 14 is accomplished by pump valve 16, which comprises valve housing 18 and valve spool 20. Valve spool 20 comprises detent mechanism 26, center feed 28, upper stop 30, and lower stop 32. Piston 14 is a substantially hollow member comprising flange 34 that is disposed about center feed 28 between upper stop 30 and lower stop 32. The outer edge of flange 34 is sealingly engaged with body 12 and the inner edge of the flange is sealingly engaged with center feed 28. The sealing engagement of flange 34 isolates fluid within housing chamber 36 from fluid within piston chamber 38

Referring now to FIG. 1, high-pressure fluid is supplied through fluid line 22 at a pressure above the fluid in which pump assembly 10 is disposed. High-pressure fluid flows through port 39 into housing chamber 36 and through center feed 28 into piston chamber 38. Although hydraulic pressure is balanced across flange 34, the high-pressure fluid within chambers 36 and 38 causes a pressure imbalance across piston 14 that extends the piston from body 12. Piston 14 will extend until flange 34 contacts lower stop 32.

As flange 34 contacts lower stop 32, the extending movement of piston 14 causes valve spool 20 to move downward with the piston. Downward movement of valve spool 20 causes detent mechanism 26 to release and allow the valve spool to move with piston 14. Valve spool 20 moves until detent mechanism 26 engages once the spool reaches the retract position as shown in FIG. 2. Once in the retract position, housing chamber 36 is in fluid communication with pressure line 24, while piston chamber 38 remains in fluid communication with pressure line 22.

Pressure line 24 supplies a low-pressure fluid to pump assembly 10. When valve spool 20 is in the retract position of FIG. 2, the low-pressure fluid of pressure line 24 is in fluid communication with housing chamber 36. The high-pressure fluid of pressure line 22 remains in fluid communication with piston chamber 38. A pressure imbalance is formed across flange 34 that urges the flange and piston 14 upward, retracting the piston within body 12. Piston 14 continues retracting until it contacts upper stop 30.

As flange 34 contacts upper stop 30, the retracting movement of piston 14 causes valve spool 20 to move upward with the piston. Upward movement of valve spool 20 causes detent mechanism 26 to release and allow the valve spool to move with piston 14. Valve spool 20 moves until detent mechanism 26 engages once the spool reaches the extend position as shown in FIG. 1. Once in the retract position, housing chambers 36 and 38 are both in fluid communication with pressure line 22 and the cycle begins again.

Figure 3:
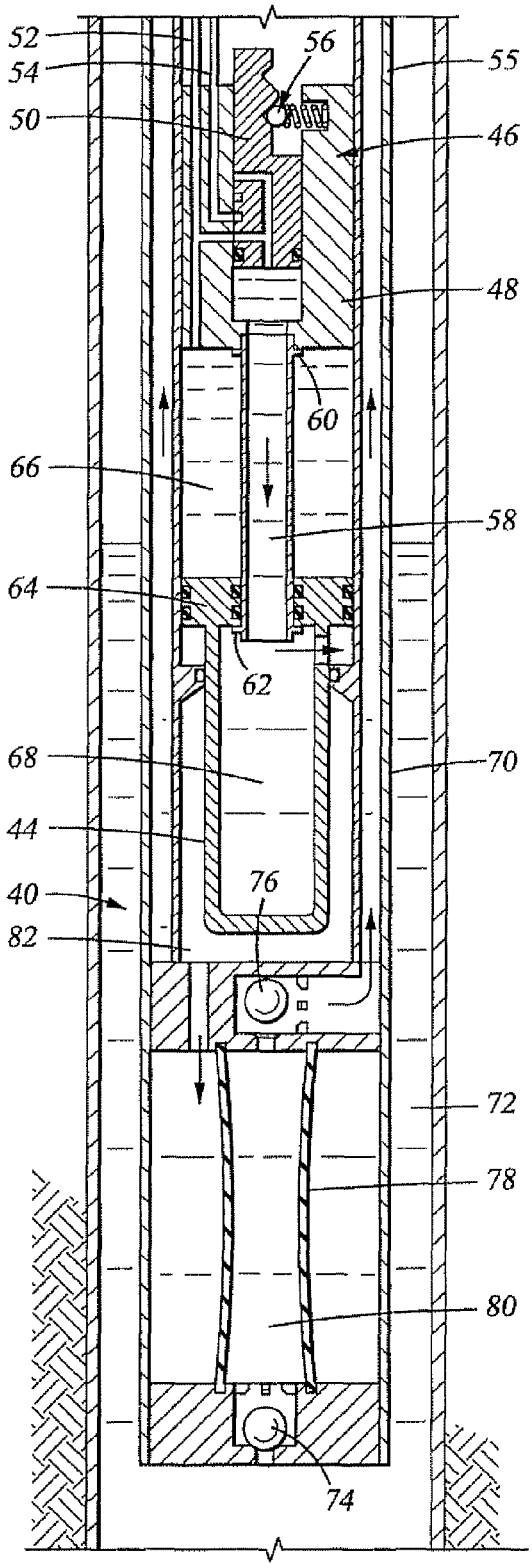
FIG. 3 is a sectional schematic view of a submersible pump assembly shown in a first position.
Figure 4:
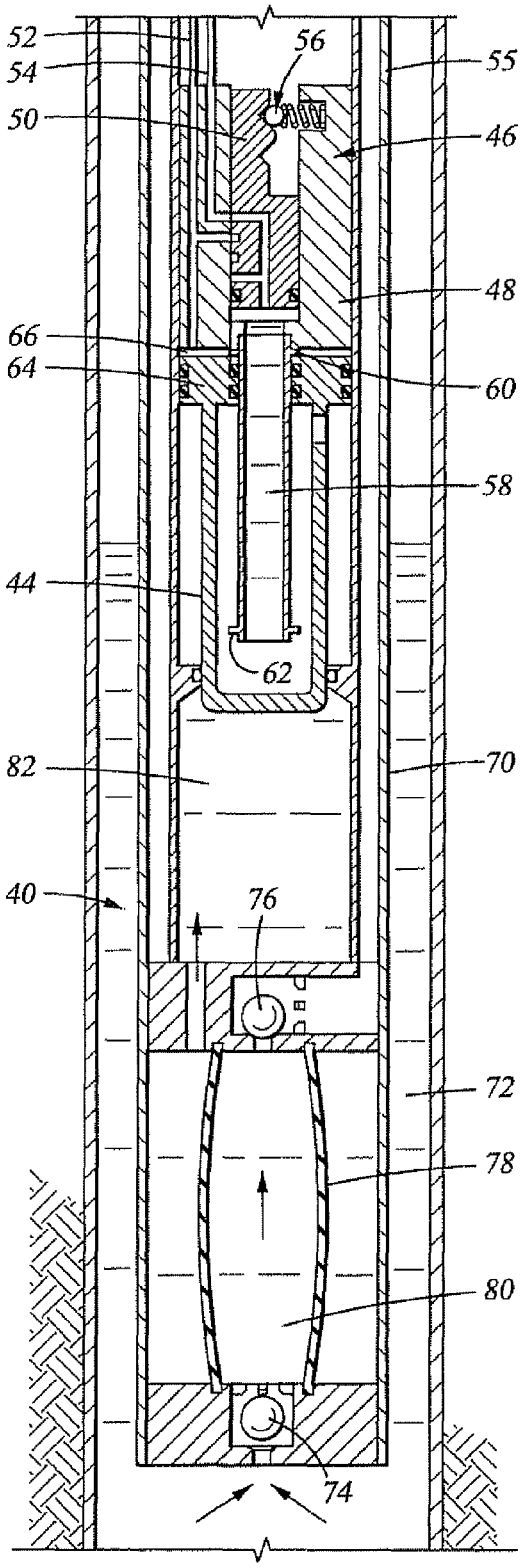
FIG. 4 is the submersible pump assembly of FIG. 3 shown in a second position.

FIGS. 3 and 4 illustrate an alternate submersible pump assembly 40 comprising body 42, piston 44, pump valve 46, valve body 48, and valve spool 50. Pressurized fluid lines 52 and 54 supply hydraulic fluid to valve 46, Pump valve 46 enables piston 44 to move axially relative to valve housing 48 and body 42 in response to fluid supplied through fluid lines 52 and 54. Pump assembly 40 is disposed within pump housing 70, which is disposed within wellbore 72. Pump housing 70 comprises inlet valve 74, outlet valve 76, and diaphragm 78. Diaphragm 78 isolates wellbore fluids within pump chamber 80 separate from working chamber 82.

FIG. 3 illustrates pump assembly 40 in an extended position where piston 44 is at its maximum extension from body 42. As piston 44 extends, the pressure within pump chamber 80 and working chamber 82 increases, opening outlet valve 76 and moving fluid up through tubing 84. FIG. 4 illustrates pump assembly 40 in a retracted position where piston 44 is at its maximum retraction into body 42. As piston 44 retracts into body 42, the pressure within pump chamber 80 and working chamber 82 decreases, opening inlet valve 74 and drawing fluid from the wellbore into the pump chamber. Thus, wellbore fluids are pumped upward through tubing 84 by reciprocating piston 44 between its extended and retracted positions.

The reciprocation of piston 44 is accomplished by pump valve 46, which comprises valve housing 48 and valve spool 50. Valve spool 50 comprises detent mechanism 56, center feed 58, upper stop 60, and lower stop 62. Piston 44 is a substantially hollow member comprising flange 64 that is disposed about center feed 58 between upper stop 60 and lower stop 62. The outer edge of flange 64 is sealingly engaged with body 42 and the inner edge of the flange is sealingly engaged with center feed 58. The sealing engagement of flange 64 isolates fluid within housing chamber 66 from fluid within piston chamber 68.

Referring now to FIG. 3, low-pressure fluid is supplied through fluid line 52 at a pressure above the fluid in which pump assembly 40 is disposed. Low-pressure fluid flows through port 69 into housing chamber 66 and through center feed 58 into piston chamber 68. Although hydraulic pressure is balanced across flange 34, the low-pressure fluid within chambers 66 and 68 causes piston 44 to extend from body 42 into the lower pressure fluid surrounding pump assembly 40. Piston 44 will extend until flange 64 contacts lower stop 62.

As flange 64 contacts lower stop 62, the extending movement of piston 44 causes valve spool 50 to move downward with the piston Downward movement of valve spool 50 causes detent mechanism 56 to release and allow the valve spool to move with piston 44. Valve spool 50 moves until detent mechanism 56 engages once the spool reaches the retract position as shown in FIG. 4, Once in the retract position, housing chamber 66 remains in fluid communication with pressure line 52, while piston chamber 68 is now in fluid communication with pressure line 54.

Pressure line 54 supplies a high-pressure fluid to pump assembly 40, when valve spool 50 is in the retract position of FIG. 4, the high-pressure fluid of pressure line 54 is in fluid communication with piston chamber 68. The low-pressure fluid of pressure line 52 remains in fluid communication with housing chamber 66. A pressure imbalance is formed across flange 64 that urges the flange and piston 44 upward, retracting the piston within body 42. Piston 44 continues retracting until it contacts upper stop 60.

As flange 64 contacts upper stop 60, the retracting movement of piston 44 causes valve spool 50 to move upward with the piston. Upward movement of valve spool 50 causes detent mechanism 56 to release and allow the valve spool to move with piston 44. Valve spool 50 moves until detent mechanism 56 engages once the spool reaches the extend position as shown in FIG. 3. Once in the retract position, chambers 66 and 68 are both in fluid communication with pressure line 52 and the cycle begins again.

It is understood that either of the pump valve assemblies described above can be used in either pump assembly described and in a variety of other submersible pumps and non-submersible pumps. Submersible pumps utilizing pump valves as described herein may be tubing conveyed, wireline conveyed, or lowered into a wellbore using the fluid supply lines that are connected to the pump assembly. In certain embodiments, the fluid supply lines may be integrated into the tubing string and coupled to the pump assembly via a specially constructed landing nipple or other junction.

Submersible pumps may utilize any fluid as an operating fluid. Submersible pumps may be operated with an operating fluid having a low viscosity so as to reduce pressure losses through the fluid supply lines. In certain embodiments, the operating fluid may be water, water combined with an anti-wear or anti-freezing additive, or other fluid having a viscosity of less than 4 centipoise. Pumping a fluid having a low viscosity may require the use of specially designed pumping systems.

In some embodiments, a pumping system for a low viscosity fluid may comprise two fluids separated by a barrier. Pressure generation and control functions are accomplished using a higher viscosity fluid while power is transmitted to the submersible pump by a low viscosity fluid. A barrier such as a rubber membrane accumulator; immiscible fluids, or hydraulic intensifiers separates the two fluids and allows for efficient transfer of pressure between the fluids.

Fluid intensifiers operate to transform flow rate and pressure within the hydraulic system in order to maximize pressure and minimize flow rate so as to reduce loss. Intensifiers may be used within the high viscosity system with the main hydraulic pump. For example, if a high viscosity system can produce fluid at 2500 psi, a two-to-one intensifier can be used to increase pressure within the low viscosity system to 5000 psi while reducing the flow rate by a factor of two, A similar, but reversed, arrangement can be used near the submersible pump to increase flow rates to the extend side of the pump cylinder so that the pump operates faster but at lower pressures.

In some embodiments, the pressure lines supplying fluids to a submersible pump may be sized so as to enhance the velocity of the fluid flowing through the line. Submersible pumps operate in an extend mode and a retract mode. More fluid per unit of travel is consumed, and therefore a greater flow rate is needed, in the low pressure mode where the piston is extending than in the high pressure mode where the piston is retracting. Therefore, in some embodiments the pressure line coupled to the extend side of the valve may have a larger diameter than the pressure line coupled to the retract side.

Figure 5:
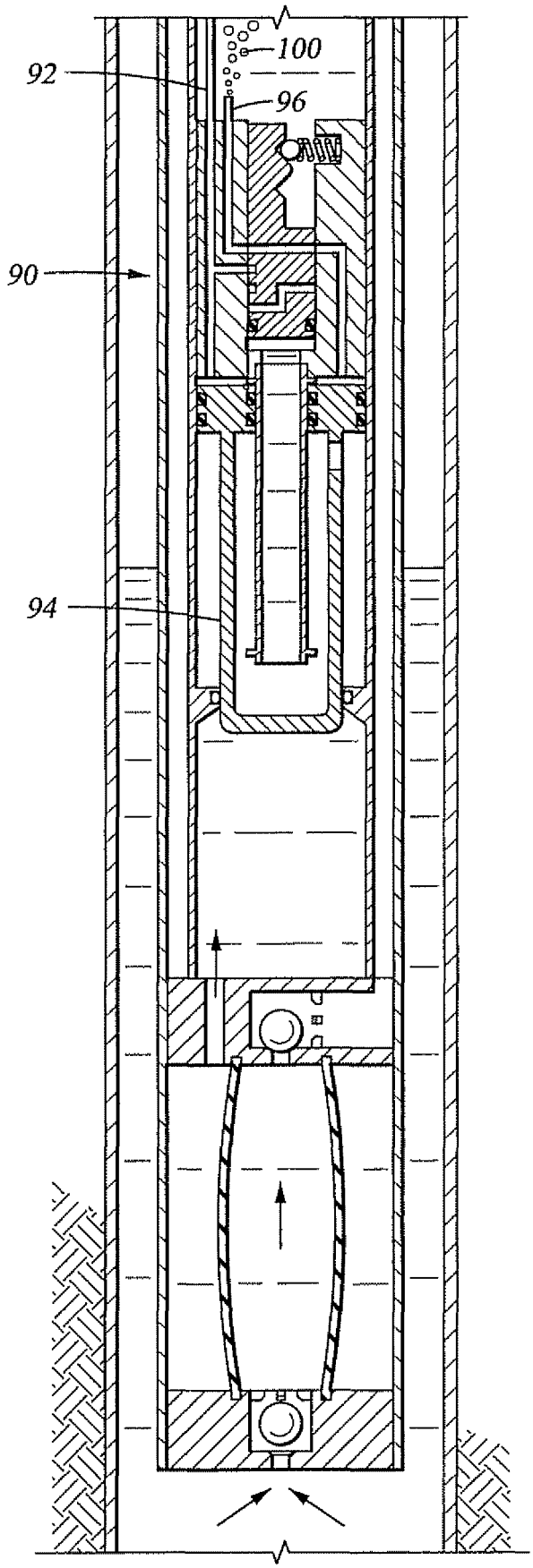
FIG. 5 is a sectional schematic view of a submersible pump assembly.

In some embodiments, a submersible pump may only have a single pressure line that supplies operating fluid to the pump. Operating fluid leaving the pump flows into the tubing string and is returned to the surface with the wellbore fluid. FIG. 5 illustrates a single-line submersible pump assembly 90 where operating fluid is supplied to the pump through fluid line 92. As with pump assembly 40 described above, operating fluid supplied through fluid line 92 provides the power to extend and retract piston 94. As piston 94 retracts, operating fluid is expelled from pump assembly 90 though outlet 96.

Thus, the return fluid flow from the low pressure side of pump assembly 90 is mixed with the pumped wellbore fluid and returns to the surface through tubing string 98. Significant advantages can be obtained in this configuration, especially if the operating fluid is either water that can be filtered at the surface and returned to the hydraulic pump or if gas or a foaming agent is used as the operating fluid. With a gaseous or foaming working fluid, as the exhaust from the valve is mixed with the pumped fluid gas bubbles 100 are formed, Gas bubbles 100 reduce the density of the pumped fluid column, thus reducing the load on the pump. Under some ranges of operation, the pump can run entirely on chemical energy released by the foaming reaction.

In the above described embodiments, the movement of the piston causes well fluid to be drawn into and then expelled through the check valves, creating a pumping action. The diaphragm contains clean fluid that is compatible with the fluid in the cylinder and serves as a barrier between the well fluid being pumped and the area around the piston seal. The piston seal, as well as the other seals in the cylinder, are typically made of a resilient material, and designed to provide zero clearance by energized contact between the seal and the piston rod. Without the diaphragm, the seals would be exposed to debris that would substantially shorten the life of the pump.

Figure 6:
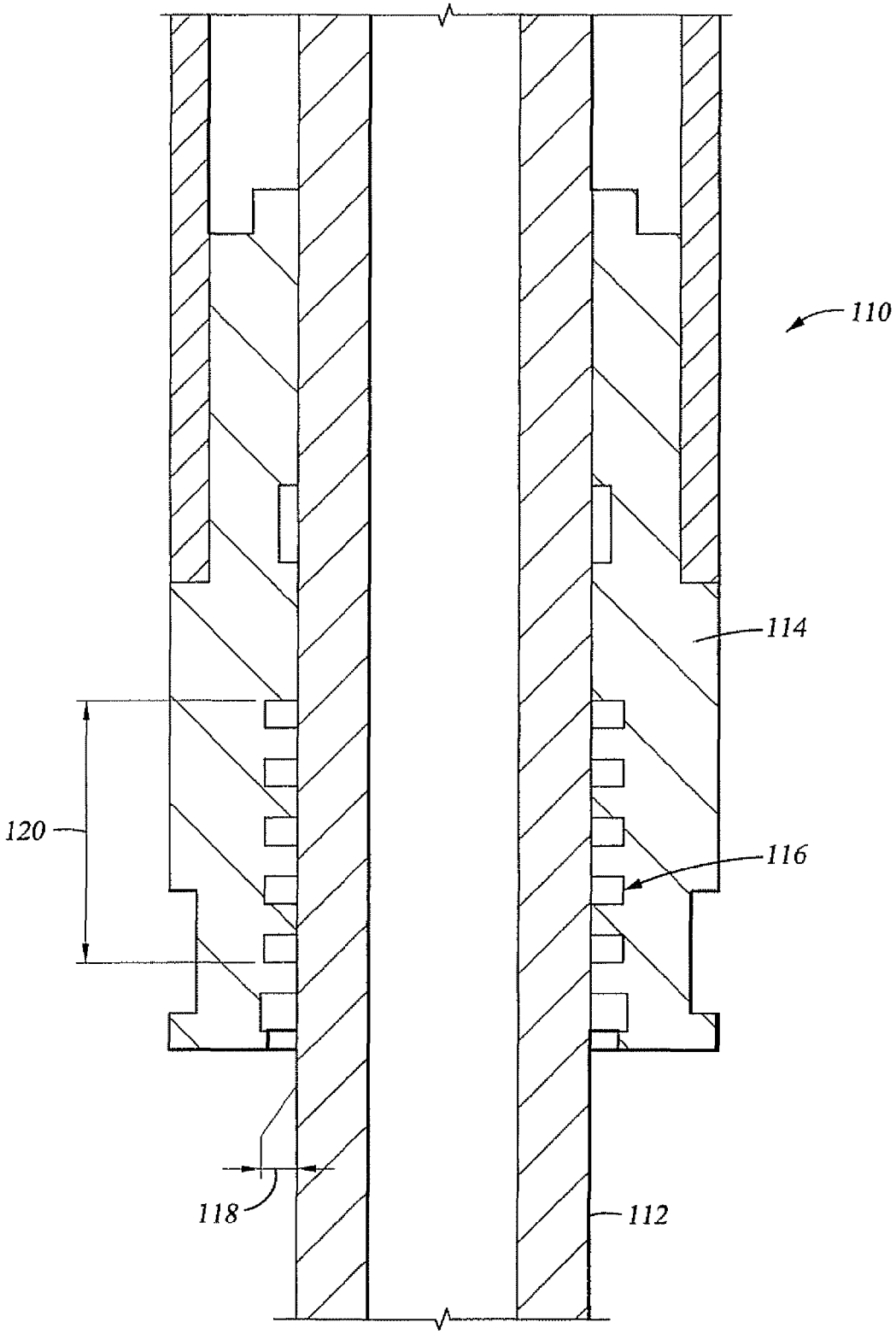
FIG. 6 is a partial sectional view of a piston seal.

In some embodiments, the resilient piston seal may be replaced with a non-contacting piston seal that relies on a tight and torturous path plus hard materials to maintain a seal. Referring to FIG. 6, pump assembly 110 comprises piston 112 and cylinder 114 having a non-contacting piston seal 116 therebetween. Piston seal 116 comprises a small clearance 118, on the order of 0.0005 inches, and a long length 120 of at least 5000 times the clearance. In certain embodiments, the interfacing surfaces on the piston and/or cylinder may comprise turbulence-inducing features (not shown), such as grooves or dimples.

The interfacing surfaces may also comprise hard materials and/or coatings such that a smooth, abrasion resistant surface is maintained in the seal area. The materials used are preferably harder then any debris that might be encountered in the application. Examples of such materials are hard chrome, carbide, diamond, nitrided steel, carbided steel, and non-metals such a ceramic or ceramic coatings. Other similar materials could also be used.

As operating fluid will slowly flow across seal 116, a system utilizing a non-contacting seal is preferably able to make up the inevitable loss of operating fluid. This flow of fluid across seal 116 may also have beneficial effects. First, if the operating fluid may contain materials that reduce corrosion or provide other favorable chemical reactions in the well. In certain embodiments, the flow of working fluid across the seal may be sufficient to eliminate the need for a secondary, high pressure chemical pump such as are commonly used in association with downhole pumping systems to inject chemicals. Second, the flow of clean operating fluid from the seal may force debris away from the seal, thus reducing the possibility that the seal will become damaged or jammed by debris. In certain embodiments, a wiper, facing away from the seal, can be used to further protect the gap from the lodging of debris.

Figure 7:
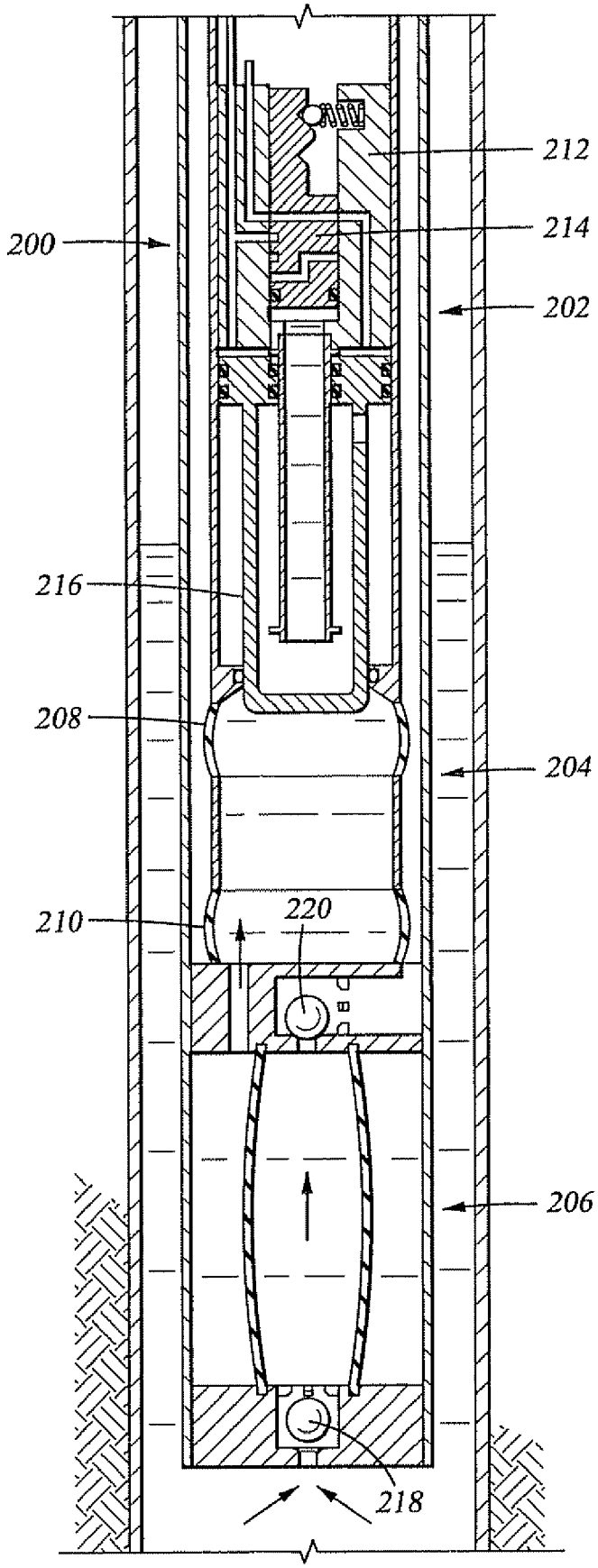
FIG. 7 is a sectional schematic view of an articulated pump assembly.

Many wells are drilled horizontally in order to increase contact between the wellbore and the hydrocarbon-containing reservoir. Pumping these horizontal wells can be problematic due to the curvature of the casing creating the need to push submersible pumps past the curvature into the horizontal sections of the well. Therefore, submersible pumping systems could be used in a wider variety of wells if the submersible pump could easily travel through curved and deviated portions of a well. In order to allow a submersible pump to easily travel through curved and deviated portions of a well, the overall length of the rigid sections of the pump must be able to pass through the curved casing. Where this can not be accomplished simply by reducing the size of the pump, the pump may be articulated by subdividing the rigid portion into smaller sections interconnected by flexible couplings as are shown in FIG. 7. The flexible couplings may be a specially designed flexible coupling or a flexible hose providing fluid communication between adjacent sections.

FIG. 7 illustrates an articulated submersible pump assembly 200 comprising power section 202, hydraulic section 204, and valve section 206. Power section 202 is coupled to hydraulic section 204 via flexible coupling 208. Hydraulic section 204 is coupled to valve section 206 via flexible coupling 210. Power section 202 comprises pump valve 212 including valve spool 214 and piston 216. Valve section 206 comprises inlet valve 218, outlet valve 220, and diaphragm 222. Pressurized fluid lines 224 supply hydraulic fluid to valve section 206.

Flexible couplings 208 and 210 interconnect adjacent sections of pump assembly 200 would preferably be able to withstand the pushing and pulling forces imparted on the pump as well as the pressure capability of the pumping system. As pump assembly 200 moves through an angled or curved portion of the wellbore, flexible couplings 208 and 210 allow the interconnected sections 202, 204, and 206 to flex relative to one another so that the pump assembly can pass through the angled or curved portion of the wellbore.

The preferred embodiments of the present invention relate to apparatus for pumping fluids from a wellbore. The present invention is susceptible to embodiments of different forms. There are shown in the drawings, and herein will be described in detail, specific embodiments of the present invention with the understanding that the present disclosure is to be considered an exemplification of the principles of the invention, mid is not intended to limit the invention to that illustrated and described herein. In particular, various embodiments of the present invention provide apparatus and methods for improving the operation of a submersible pumping system. Reference is made to the application of the concepts of the present invention to submersible pumping systems, but the use of the concepts of the present invention is not limited to these applications, and can be used for any other applications including other reciprocating systems. It is to be fully recognized that the different teachings of the embodiments discussed below may be employed separately or in any suitable combination to produce desired results.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A submersible pumping system comprising:

a body;

a piston disposed within a cylinder, the piston translatable between an extended position and a retracted position;

a pump valve in fluid communication with a fluid source, the pump valve comprising a center feed providing fluid communication between the piston chamber and the fluid source;

wherein the pump valve comprises:

a valve housing coupled to the body; and a valve spool comprising the center feed, wherein the center feed is partially disposed within the piston;

wherein the pump valve has a first position in which the pump valve supplies an operating fluid so as to move the piston to the extended position and a second position in which the pump valve supplies the operating fluid so as to move the piston to the retracted position;

an upper stop coupled to the center feed, wherein the pump valve is actuated to the first configuration when the upper stop is engaged by the piston in the retracted position; and a lower stop coupled to the center feed, wherein the pump valve is actuated to the second configuration when the lower stop is engaged by the piston in the extended position.

2. The system of claim 1, further comprising:

a pump housing coupled to the body;

an inlet valve that controls flow of fluid into the pump housing; and an outlet valve that controls the flow of fluid out of the pump housing.

3. The submersible pumping system of claim 1, wherein the piston is configured as a flange that is disposed about the center feed between the upper stop and the lower stop, wherein the piston has an outer edge sealingly engaged with the body and an inner edge sealingly engaged with the center feed so as to form a housing chamber and a piston chamber.

4. The submersible pumping system of claim 3, wherein as the piston is moved to the extended position, both the housing chamber and the piston chamber are in fluid communication with a supply fluid from the fluid source.

5. The submersible pumping system of claim 3, wherein as the piston is moved to the retracted position, the housing chamber is in fluid communication with a supply fluid from the fluid source.

6. The submersible pumping system of claim 1, wherein the valve spool further comprises a detent mechanism that releasably couples the valve spool to the valve housing, wherein the valve spool is disengaged from the valve housing and movable relative to the valve housing when the piston is in either the extended position or the retracted position and wherein the valve spool is engaged with the valve housing when the piston is moving.

7. A submersible system for pumping a fluid comprising:

a housing having an inlet valve and an outlet valve;

a flexible diaphragm coupled between the inlet valve and the outlet valve, the diaphragm separating a working chamber and a pump chamber;

a piston disposed within the working chamber, the piston translatable between an extended position and a retracted position;

a pump valve in fluid communication with at least one fluid source, the pump valve actuatable between a first position and a second position, wherein, in the first position, the pump valve supplies an operating fluid so as to move the piston from the retracted position to the extended position, whereby the volume of the pump chamber changes and the fluid is exhausted from the pump chamber through the outlet valve;

wherein, in the second position, the pump valve supplies operating fluid so as to move the piston from the extended position to the retracted position, whereby the volume of the pump chamber changes and the fluid is drawn into the pump chamber through the inlet valve;

an upper stop coupled to the pump valve, wherein the pump valve is actuated to the first configuration when the upper stop is engaged by the piston in the retracted position; and a lower stop coupled to the pump valve, wherein the pump valve is actuated to the second configuration when the lower stop is engaged by the piston in the extended position;

wherein the pump valve comprises a center feed providing fluid communication between a piston chamber formed within the piston and the at least one fluid source;

wherein the center feed supports the upper stop and the lower stop.

8. The system of claim 7, wherein the pump valve comprises:

a valve housing; and a valve spool, the valve spool translatable relative to the valve housing between a first position, wherein the pump valve is in the first configuration, and a second position, wherein the pump valve is in the second configuration.

9. The system of claim 8, further comprising a detent mechanism releasably coupling the valve spool and the valve housing, wherein the valve spool is disengaged from the valve housing and movable relative to the valve housing when the piston is at the end of either the extended or retracted position and does not move relative to the valve housing when the piston is moving.

10. The system of claim 7, wherein the piston further comprises a flange that is disposed about the center feed between the upper stop and the lower stop, wherein the flange has an outer edge sealingly engaged with the body and an inner edge sealingly engaged with the center feed so as to form the housing chamber and the piston chamber.

11. The system of claim 8, wherein the volume of the pump chamber increases as the piston moves towards the extended position and decreases as the piston moves toward the retracted position.

12. The system of claim 8, wherein the volume of the pump chamber decreases as the piston moves towards the extended position and increases as the piston moves toward the retracted position.

* * * * *